US007667653B2

(12) United States Patent
Miyoshi

(10) Patent No.: US 7,667,653 B2
(45) Date of Patent: Feb. 23, 2010

(54) ANTENNA UNIT COMPRISING FIRST AND SECOND ANTENNA PATTERNS

(75) Inventor: Akira Miyoshi, Tokyo (JP)

(73) Assignee: Mitsumi Electric Co., Ltd., Tama-Shi (JP)

( * ) Notice: Subject to any disclaimer, the term of this patent is extended or adjusted under 35 U.S.C. 154(b) by 0 days.

(21) Appl. No.: 12/114,069

(22) Filed: May 2, 2008

(65) Prior Publication Data

US 2008/0278380 A1 Nov. 13, 2008

(30) Foreign Application Priority Data

May 7, 2007 (JP) ..... 2007-122373

(51) Int. Cl.
*H01Q 1/38* (2006.01)

(52) U.S. Cl. ..... 343/700 MS; 343/702

(58) Field of Classification Search ..... 343/700 MS, 343/702, 846, 829
See application file for complete search history.

(56) References Cited

U.S. PATENT DOCUMENTS

| | | | | |
|---|---|---|---|---|
| 4,070,676 | A * | 1/1978 | Sanford | 343/700 MS |
| 5,557,293 | A * | 9/1996 | McCoy et al. | 343/867 |
| 6,008,773 | A | 12/1999 | Matsuoka et al. | |
| 6,037,911 | A * | 3/2000 | Brankovic et al. | 343/795 |
| 6,100,848 | A | 8/2000 | Hayes | |
| 6,452,556 | B1 * | 9/2002 | Ha et al. | 343/702 |
| 7,084,820 | B2 | 8/2006 | Noro et al. | |
| 7,151,500 | B2 | 12/2006 | Su et al. | |
| 2004/0222929 | A1 | 11/2004 | Asano et al. | |
| 2004/0246180 | A1 | 12/2004 | Okado | |
| 2005/0264458 | A1 | 12/2005 | Takagi et al. | |
| 2006/0208949 | A1 | 9/2006 | Hirabayashi | |

FOREIGN PATENT DOCUMENTS

| | | | |
|---|---|---|---|
| EP | 1 696 504 | A1 | 8/2006 |
| JP | 6-188610 | A | 7/1994 |
| JP | 10-150319 | A | 6/1998 |
| JP | 11-506283 | A | 6/1999 |
| JP | 2004-228983 | A | 8/2004 |
| JP | 2005020058 | A * | 1/2005 |
| JP | 2005-79867 | A | 3/2005 |
| JP | 2006-50517 | A | 2/2006 |
| JP | 2006-54847 | A | 2/2006 |

OTHER PUBLICATIONS

Extended European Search Report dated Jul. 1, 2008 issued in counterpart European Appln. No. 08154536.0.
Japanese Office Action dated Mar. 25, 2009 and English translation thereof issued in a counterpart Japanese Application No. 2007-122373.

* cited by examiner

*Primary Examiner*—Tho G Phan
(74) *Attorney, Agent, or Firm*—Frishauf, Holtz, Goodman & Chick, P.C

(57) ABSTRACT

An antenna unit includes a board having first and second surfaces opposite to each other, a first antenna pattern, formed on the first surface of the board, for transmitting and receiving a first radio wave having a first frequency band, and a second antenna pattern, formed on the second surface of the board, for transmitting and receiving a second radio wave having a second frequency band different from the first frequency band. The first antenna pattern and the second antenna pattern are disposed so as to be opposed to each other through the board with they electrically disconnected.

8 Claims, 5 Drawing Sheets

ANTENNA UNIT COMPRISING FIRST AND SECOND ANTENNA PATTERNS

This application is based upon and claims the benefit or priority from Japanese patent application No. 2007-122373, filed on May 7, 2007, the disclosure of which is incorporated herein its entirety by reference.

BACKGROUND OF THE INVENTION

This invention relates to an antenna unit and, more particular, to an antenna unit for use in a frequency band of a wireless Local Area Network (LAN).

In the manner which is well known in the art, the wireless LAN is an LAN using a transmission path except for a wired cable, such as electric waves, infrared rays, or the like.

Standardization of the wireless LAN is developed in IEEE (Institute of Electrical and Electronics Engineers) 802.11 Committee. That is, the IEEE 802.11 Committee develops specifications of the standard of the wireless LAN.

For example, IEEE 802.11a is a specification of a high-speed wireless LAN and a wireless access for 5 GHz band where the IEEE 802.11 Committee develops. A communication rate (a transfer rate) is about 20 Mbits/sec to 50 M bits/sec. A CSMA/CD (carrier sense multiple ac cess with collision detection) is used as an MAC (media access control). A modulation method of a physical layer is an OFDM (orthogonal frequency division multiplex).

On the other hand, IEEE 802.11b is a specification of the wireless LAN where the IEEE 802.11 Committee standardizes in September, 1999. The IEEE 802.11b uses frequencies of 2.4 GHz band and uses a direct spread (DS) as a modulation method. A transmission rate (a transfer rate) is 11 Mbits/sec or 5.5 Mbits/sec.

Furthermore, IEEE 802.11g is one of standards for the wireless LAN where the IEEE 802.11 Committee develops in June, 2003 and a specification for carrying out communications about 54 Mbits/sec at 2.4 GHz band. The OFDM is used as a modulation method. Accordingly, the IEEE 802.11g uses the frequencies of 2.4 GHz band which is similar to that of the IEEE 802.11b and supports the transfer rate of 54 Megabits/sec which is about five times of that of the IEEE 802.11b. In contrast to the IEEE 802.11a for supporting the transfer rate of 54 Mbits/sec, the IEEE 802.11g maintains compatibility with the IEEE 802.11b. In addition, although a maximum transfer rate of 54 Mbits/sec is similar to that of the IEEE 802.11a. the 2.4 GHz band is a "busy" frequency band where a lot of equipments except for the wireless LAN use. Therefore, it is said that a real transfer rate in the IEEE 802.11g becomes later than that of the IEEE 802.11a.

Inasmuch as the IEEE 802.11b and the IEEE 802.11g use the same use frequency band of 2.4 GHz band in the manner which is described above, both are collectively called IEEE 802.11b/g herein.

Various antenna devices used in the frequency band of the wireless LAN are already known in the art. By way of example, JP 2006-50517 A, which corresponds to U.S. Pat. No. 7,084,820 B2, discloses an antenna device having a resonance frequency of 2.456 GHz. This patent document will be called a first patent document. The first patent document discloses, in FIG. 8 thereof, the antenna device where an antenna pattern (a conductive pattern) is formed on a main surface (a front side, a first surface) of a substrate or a board. Specifically, the antenna device disclosed in the first patent document comprises, as the antenna pattern (the conductive pattern) formed on the main surface of the board, a first L-shaped wiring pattern, a second L-shaped wiring pattern, an L-shaped ground pattern, and an L-shaped signal pattern which are an U-shape as a whole. The first and the second L-shaped wiring patterns have first and second tips, respectively, which are opposed to each other with a space therebetween. The first and the second L-shaped wiring patterns are substantially symmetric with respect to a central line of the board. The L-shaped ground pattern has an end which is electrically connected to the second tip of the second L-shaped wiring pattern. The L-shaped ground pattern is formed on the main surface of the board so that it lies inside the second L-shaped wiring pattern with a space and along the second L-shaped wiring pattern. The L-shaped signal pattern has an end which is electrically connected to the first tip of the first L-shaped wiring pattern. The L-shaped signal pattern is formed on the main surface of the board such that it lies inside the L-shaped ground pattern with a space and along the L-shaped ground pattern. In addition, the antenna device further comprises a coaxial cable (feeder) which includes a central conductor and an outer conductor. At an end portion of the coaxial cable, the central conductor is electrically connected to another end of the L-shaped signal pattern and the outer conductor is electrically connected to another end of the L-shaped ground pattern.

At any rate, the first patent document discloses the antenna device which comprises the board having the first surface and the antenna pattern (a first transmission/reception pattern), formed on the first surface, for transmitting and receiving a radio signal (the radio wave) having a first frequency band.

On the other hand, JP 2005-79867 A discloses a flat-shaped antenna which has a sufficient input impedance and carries out efficient operation as the antenna although a metallic cabinet or a metallic part exists nearby. This patent document will be called a second patent document. The second patent document disclosed the flat-shaped antenna where favorable impedance matching is carried out at a frequency band of 2.4 GHz. More specifically, the flat-shaped antenna disclosed in the second patent document comprises a printed board made of a dielectric, a first antenna radiation element serving as one radiation element of a dipole antenna, a second antenna radiation element serving as another radiation element of the dipole antenna, a non-feeding element formed by a conductive pattern, a microstrip line serving as a feeding line for a radio wave, and a ground conductor for forming a ground side of the feeding line. The first antenna radiation element, the non-feeding element, and the microstrip line are formed on one surface (a front side, a first surface) of the printed board by a conductive pattern. The second antenna radiation element and the ground element are formed on another surface (a back side, a second surface) of the printed board by a conductive pattern. The dipole antenna is composed by feeding a high-frequency signal from an end portion of the microstrip line. The first antenna radiation element and the microstrip line are connected to each other around a central portion of the printed board. In addition, the non-feeding element may be omitted.

At any rate, the second patent document discloses the flat-shaped antenna (an antenna device) comprising a board having first and second surfaces (front and back sides) opposite to each other and the conductive pattern (a first transmission/reception pattern), formed on the first and the second surfaces, for transmitting and receiving the radio signal (the radio wave) having the first frequency bond.

In addition, JP 6-188610 A discloses a printed circuit board where patterns for antenna and a balun are formed on both sides or one side of the printed circuit board. This patent document will be called a third patent document. In the third patent document, a pattern for a dipole antenna and a coaxial guide fixing pattern for the balun are formed on a first surface (a frond side) of the printed circuit board while a branch conductive pattern is formed on a second surface (a back side) or the first surface of the printed circuit board. A central line of the coaxial guide is soldered to a feeding point of the dipole antenna while an outer conductor of the coaxial guide is soldered to the feeding point of the dipole antenna and the branch conductive pattern. The antenna and the balun disclosed in the third patent document are mounted inside a case of a portable radio equipment and use a frequency band between 421 MHz and 440 MHz.

At any rate, the third patent document discloses the printed circuit board (an antenna device) comprising a board having first and second surfaces (front and back sides) opposite to each other and the conductive pattern (a first transmission/reception pattern), formed on the first and the second surfaces (or the first surface) of the printed circuit board, for transmitting and receiving a radio signal (a radio wave) having a first frequency band.

Inasmuch as each of the antenna devices disclosed in the above-mentioned first through third patent documents is an antenna device where the antenna pattern is formed on the board, they are called board antennas.

In the manner which is described above, each of the antenna devices disclosed in the first through the third patent documents discloses only the antenna device (the board antenna) comprising the board and the antenna pattern (the first transmission/reception pattern) formed on one side (or both sides) of the board. The antenna devices can transmit and receive only the radio signal (the radio wave) having one kind of frequency band (the first frequency band).

SUMMARY OF THE INVENTION

It is therefore an exemplary object of the present invention to provide an antenna unit which is capable of transmitting and receiving radio signals (radio waves) having different two kinds of frequency bands.

It is another exemplary object of the present invention to provide an antenna unit which is capable of transmitting and receiving radio signals (radio waves) having different two kinds of frequency bands used in a wireless LAN.

Other objects of this invention will become clear as the description proceeds.

According to an exemplary aspect of this invention, an antenna unit comprises a board having first and second surfaces opposite to each other, a first antenna pattern, formed on the first surface of the board, for transmitting and receiving a first radio wave having a first frequency band, and a second antenna pattern, formed on the second surface of the board, for transmitting and receiving a second radio wave having a second frequency band different from the first frequency band. The first antenna pattern and the second antenna pattern are disposed so as to be opposed to each other through the board with they electrically disconnected.

DESCRIPTION OF THE PREFERRED EMBODIMENTS

Figure 1A:
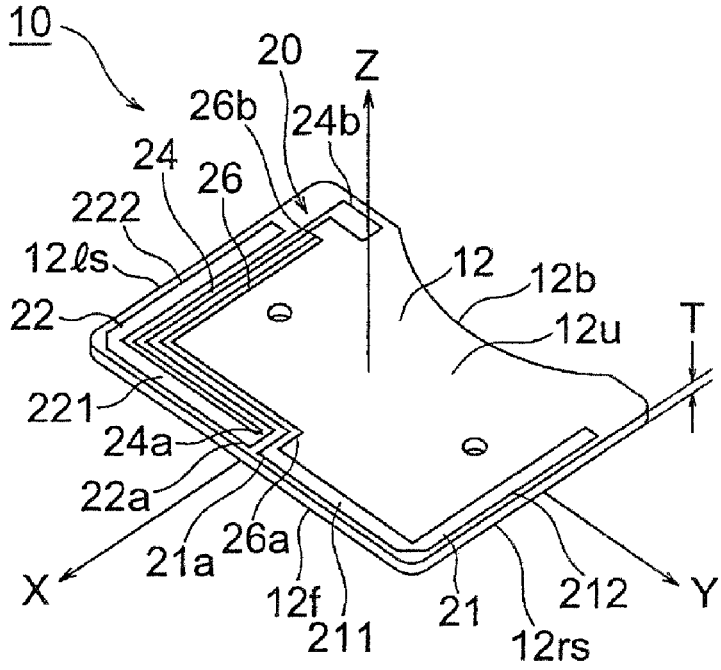
FIG. 1A is a schematic perspective view showing an antenna unit according to an exemplary embodiment of this invention from a front side.
Figure 1B:
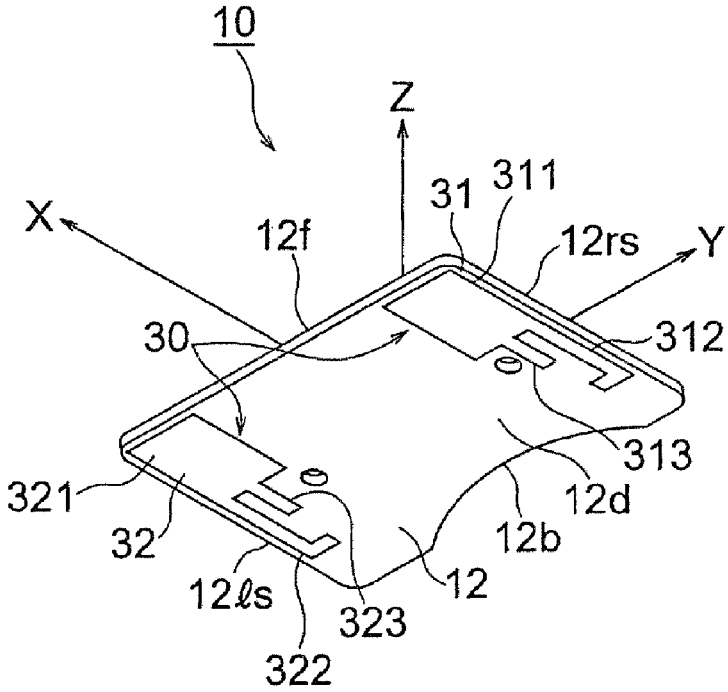
FIG. 1B is a schematic perspective view showing the antenna unit illustrated in FIG. 1A from a rear side.
Figure 2:
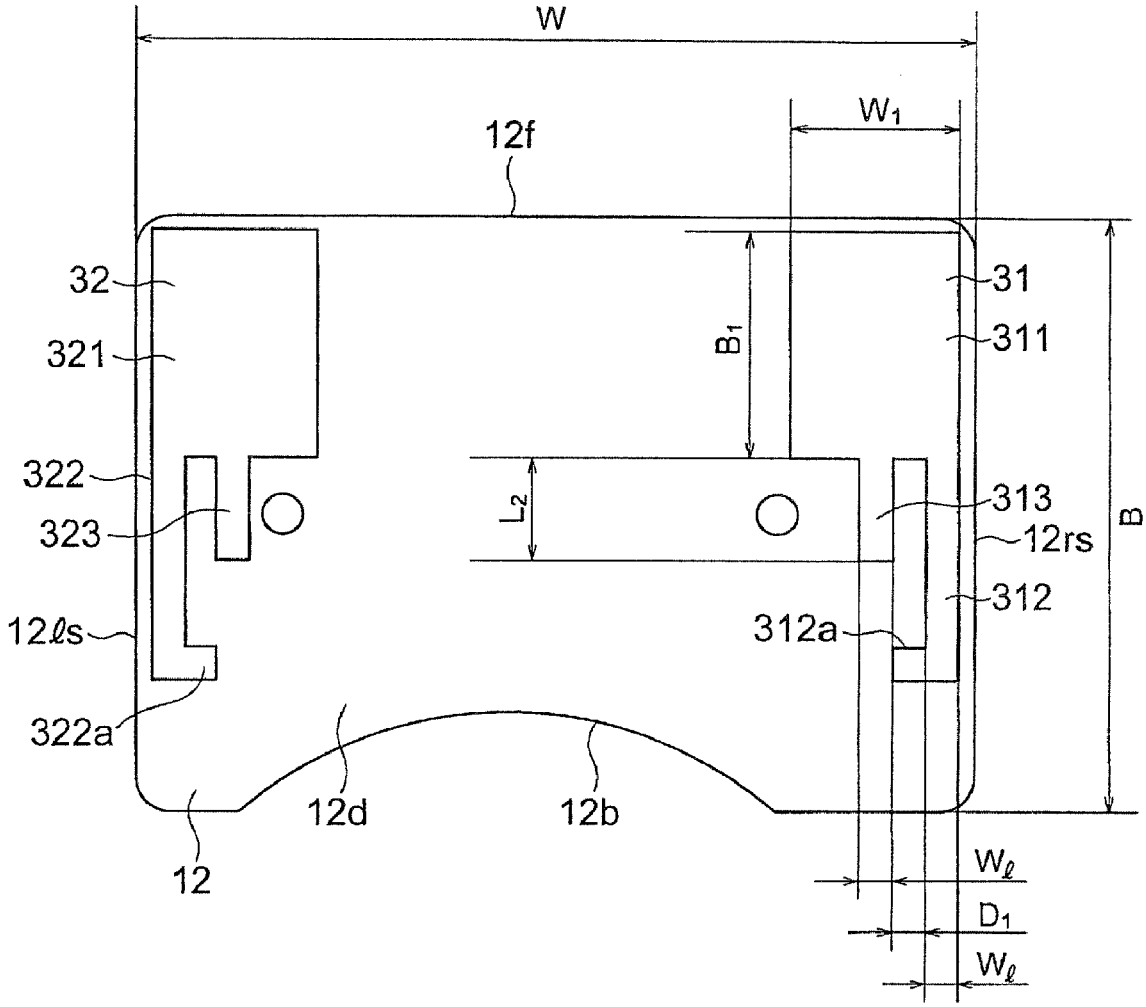
FIG. 2 is a bottom view of the antenna unit illustrated in FIGS. 1A and 1B.

Referring to FIGS. 1A, 1B, and 2, the description will proceed to an antenna unit (a board antenna) 10 according to an exemplary embodiment of this invention. FIG. 1A is a schematic perspective view showing the antenna unit (the board antenna) 10 from a front side (an upper side) while FIG. 1B is a schematic perspective view showing the antenna unit (the board antenna) 10 from a rear side (a bottom side). FIG. 2 is a bottom view of the antenna unit (the board antenna) 10.

The antenna unit 10 comprises a board or substrate 12 having a first surface (a front side, an upper surface) 12*u* and a second surface (a rear side, a lower surface) 12*d* which are opposite to each other.

Herein, an orthogonal coordinate system (X, Y, Z) having, as an origin point thereof, a center of the board 12 is used as shown in FIGS. 1A and 1B. In a state illustrated in FIGS. 1A and 1B, in the orthogonal coordinate system (X, Y. Z), an X-axis direction is a fore-and-aft direction (a depth direction), a Y-axis direction is a left-and-right direction (a width direction, a lateral direction), and a Z-axis direction is an up-and-down direction (a height direction). In addition, in the example being illustrated in FIGS. 1A and 1B, the fore-and-aft direction X is a direction of a cent line of the board 12.

The board 12 has a substantially rectangular parallelepiped (rectangular plate) shape which has a length B, a width W, and a thickness (a height) T. In the example being illustrated, the length B is equal to 18.6 mm, the width W is equal to 25.5 mm, and the thickness (the height) T is equal to 0.8 mm. In addition, in the example being illustrated, the board (the substrate) 12 is made of a dielectric board having relative permittivity $\epsilon_r$ of 4.4.

The board 12 has the upper surface (the front side) 12*u*, the lower surface (the rear side) 12*d*, a front surface 12*f*, a back surface 12*b*, a right-side surface 12*rs*, and a left-side surface 12*ls*. As shown in FIGS. 1A and 1B, the back surface 12*b* has an arc-shaped concave portion. At any rate, the board 12 is substantially bilaterally symmetric with respect the center line (the fore-and-aft direction) X.

The antenna unit (the board antenna) 10 comprises a first antenna pattern 20 formed on the first surface (the upper surface, the front side) 12*u* of the board 12 and a second antenna pattern 30 formed on the second surface (the lower surface, the rear side) 12*d* of the board 12. The first antenna pattern 20 is for transmitting and receiving a first radio wave having a first frequency band which will later be described. The second antenna pattern 30 is for transmitting and receiving a second radio wave having a second frequency band which will later be described. The first frequency band and the second frequency band are different from each other. As shown in FIGS. 1A and 1B, the first antenna pattern 20 and the second antenna pattern 30 are electrically disconnected from each other and are disposed oppose to each other through the board 12. In other words, the first antenna pattern 20 and the second antenna pattern 30 act to each other at radio frequencies.

In the example being illustrated, the first frequency band is a frequency band of 2.4 GHz which is used in IEEE 802.11b/g while the second frequency band is a frequency band of 5 GHz which is used in IEEE 802.11a.

As shown in FIG. 1A, the first antenna pattern 20 extends in an L-shape fashion at both sides (a side-to-side) with respect to the center line X of the board 12 and has a substantially U-shape as a whole. On the other hand, as shown in FIG. 1B, the second antenna pattern 30 comprises a pair of conductive patterns 31 and 32 which are symmetrically formed at the both side (the side-to-side) with respect to the center line X of the board 12.

Referring now to FIG. 1A, the description will proceed to the first antenna pattern 20. The illustrated first antenna pattern 20 is a pattern which is substantially similar to that illustrated in FIG. 8 of the above-mentioned first patent document (JP 2006-50517 A).

More specifically, the first antenna pattern 20 comprises first and second L-shaped wiring pattern 21 and 22, an L-shaped ground pattern 24, and an L-shaped signal pattern 26.

The first and the second L-shaped wiring pattern 21 and 22 are formed at a first side (a right-hand side) and a second side (a left-hand side) which are opposite to each other with respect to the center line X of the board 12, respectively. The first and the second L-shaped wiring patterns 21 and 22 have first and second tips 21*a* and 22*a*, respectively, which are disposed at a distance from each other through the center line X of the board 12. The first L-shaped wiring pattern 21 and the second L-shaped wiring pattern 22 are formed on the upper surface 12*u* of the board so as to be substantially symmetric with respect to the center line X of the board 12.

The first L-shaped wiring pattern 21 comprises a first orthogonal wiring portion 211 and a first parallel wiring portion 212. The first orthogonal wiring portion 211 extends in a direction (a right direction) Y orthogonal to the center line X along the front surface 12*f* of the board 12 so as to leave the center line X of the board 12. The first parallel wiring portion 212 extends in parallel with the center line X along the right-side surface 12*rs* of the board 12 from a tip of the first orthogonal wiring portion 211.

Likewise, the second L-shaped wiring portion 22 comprises a second orthogonal wiring portion 221 and a second parallel wiring portion 222. The second orthogonal wiring portion 221 extends in a direction (a left direction) Y orthogonal to the center line X along the front surface 12*f* of the board 12 so as to leave the center line X of the board 12. The second parallel wiring portion 222 extends in parallel with the center line X along the left-side surface 12*ls* of the board 12 from a tip of the second orthogonal wiring portion 221.

In addition, each of the first and the second L-shaped wiring patterns 21 and 22 has a line width of 1 mm.

The L-shaped ground pattern 24 has an end 24*a* which is electrically connected to the second tip 22*a* of the second L-shaped wiring pattern 22. The L-shaped ground pattern 24 is formed on the first surface 12*u* of the board 12 such that the L-shaped ground pattern 24 lies inside the second L-shaped wiring pattern 22 with a space and along the second L-shaped wiring pattern 22. On the other hand, the L-shaped signal pattern 26 has an end 26*a* which is electrically connected to the first tip 21*a* of the first L-shaped wiring pattern 21. The L-shaped signal pattern 26 is formed on the first surface 12*u* of the board 12 such that the L-shaped signal pattern 26 lies inside the L-shaped ground pattern 24 with a space and along the L-shaped ground pattern 24.

Figure 3:
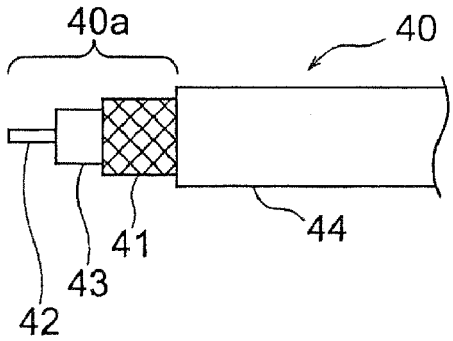
FIG. 3 is a front view showing a coaxial cable used as a feeding line of the antenna unit illustrated in FIGS. 1A and 1B.

The antenna unit (the board antenna) 10 employs, as a feeding line, a coaxial cable 40 shown in FIG. 3. As shown in FIG. 3, the coaxial cable 40 is an electric-signal transmission medium having a coaxial form, which includes a cylindrical outer conductor 41 and a central conductor 42 which lies in a center thereof. The outer conductor 41 and the central conductor 42 are insulated by a cylindrical insulator 43. In addition, the outer conductor 41 is covered with a sheath 44.

As shown in FIG. 3, at a tip portion 40*a* of the coaxial cable 40, the sheath 44, the outer conductor 41, and the insulator 43 are cut out. In addition, the tip portion 40*a* of the coaxial cable is connected to the first antenna pattern 20 in the manner which will presently be described.

That is, at the tip portion 40*a* of the coaxial cable 40, the central conductor 42 is electrically connected to another end 26*b* of the L-shaped signal pattern 26 by a solder (not shown) and the outer conductor 41 is electrically connected to another end 24*b* of the L-shaped ground pattern 24 by a solder (not shown).

Referring now to FIGS. 1B and 2, the description will proceed to the second antenna pattern 30. The pair of conductive patterns of the second antenna pattern 30 comprises a first conductive pattern 31 and a second conductive pattern 32. The first conductive pattern 31 is disposed on the second surface 12*d* of the board 12 so as to be opposed to the first L-shaped wiring pattern 21 through the board 12. The second conductive pattern 32 is disposed on the second surface 12*d* of the board 12 so as to be opposed to the second L-shaped wiring pattern 22 through the board 12.

More specifically, the first conductive pattern 31 comprises a first widened portion 311 having a rectangular shape of a length $B_1$ and a width $W_1$, a first main wiring pattern 312, and a first sub wiring pattern 313. The first widened portion 311 is disposed at a position corresponding to a curved portion of the first L-shaped wiring pattern 21 and has the width $B_1$ which is wider than the line width of the first L-shaped wiring portion 21. The first main wiring pattern 312 extends in parallel with the center line X of the board 12 along the right-side surface 12*rs* of the board 12 from the first widened portion 311 so as to be opposed to the first parallel wiring portion 212. The first main wiring pattern 312 has a tip portion 312*a* which is bended at the right angle in a direction to get near the center line X of the board 12. The first sub wiring pattern 313 extends from the first widened portion 311 and has a length $L_2$ which is shorter than a wiring length $L_1$ (see FIG. 7) of the first main wiring pattern 312. In the example being illustrated, the first sub wiring pattern 313 is apart from the first main wiring pattern 312 by a predetermined distance $D_1$ and extends in parallel with the first main wiring pattern 312.

Similarly, the second conductive pattern 32 comprises a second widened portion 321 having a rectangular shape of the length $B_1$ and the width $W_1$, a second main wiring pattern 322, and a second sub wiring pattern 323. The second widened portion 321 is disposed at a position corresponding to a curved portion of the second L-shaped wiring pattern 22 and has the width $B_1$ which is wider than the line width of the second L-shaped wiring portion 22. The second main wiring pattern 322 extends in parallel with the center line X of the board 12 along the left-side surface 12*ls* of the board 12 from the second widened portion 321 so as to be opposed to the second parallel wiring portion 222. The second main wiring pattern 322 has a tip portion 322*a* which is bended at the right angle in a direction to get near the center line X of the board 12. The second sub wiring pattern 323 extends from the second widened portion 321 and has the length $L_2$ which is shorter than the wiring length $L_1$ (see FIG. 7) of the second main wiring pattern 322, In the example being illustrated, the second sub wiring pattern 323 is apart from the second main wiring pattern 322 by the predetermined distance $D_1$ and extends in parallel with the second main wiring pattern 322.

Referring to FIG. 2, the descry ption will be made as regards dimension of the second antenna pattern 30. Each of the first and the second widened portions 311 and 321 has the length $B_1$ of 7 mm and the width $W_1$ of 5 mm. Each of the first and the second main wiring patterns 312 and 322 has the line width $W_1$ of 1 mm and the wiring length $L_1$ of 9 mm. The predetermined distance $D_1$ is equal to 1 mm. Each of the first and the second sub wiring patterns 313 and 323 has the line width $W_1$ of 1 mm and the wiring length $L_2$ of 3.2 mm.

In the manner which is known in the art, it is generally preferable that a voltage standing wave ratio (VSWR) of an antenna unit is close to one as much as possible as a necessary antenna characteristic. Desirably, the VSWR may be two or less.

Figure 4:
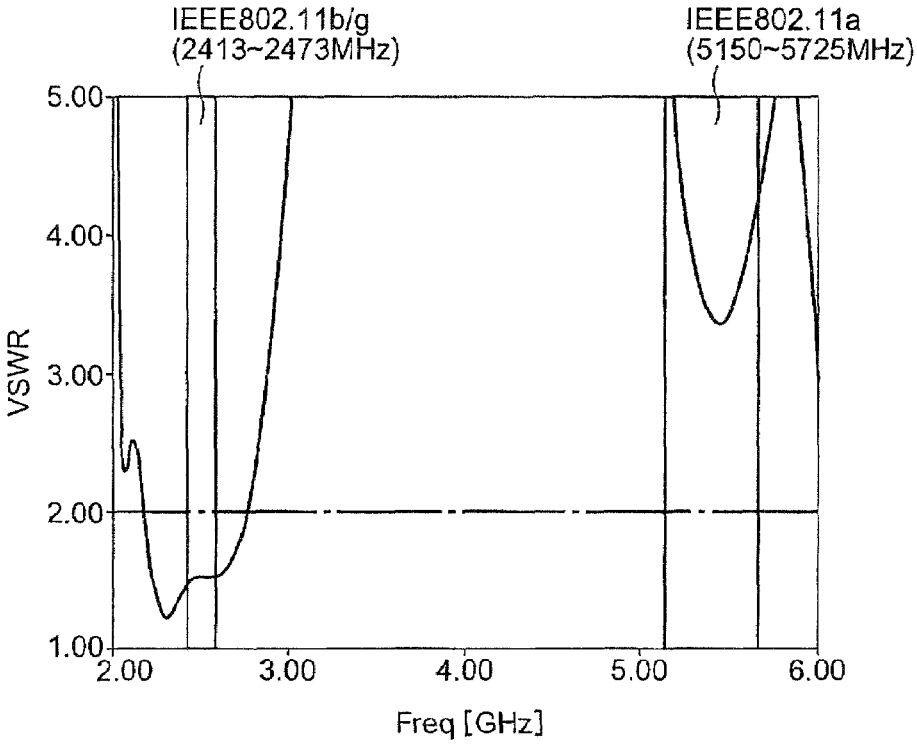
FIG. 4 RELATED ART
FIG. 4 is a view showing a frequency characteristic of a VSWR of an antenna unit where a second antenna pattern is deleted from the antenna unit illustrated in FIGS. 1A and 1B.
Figure 5:
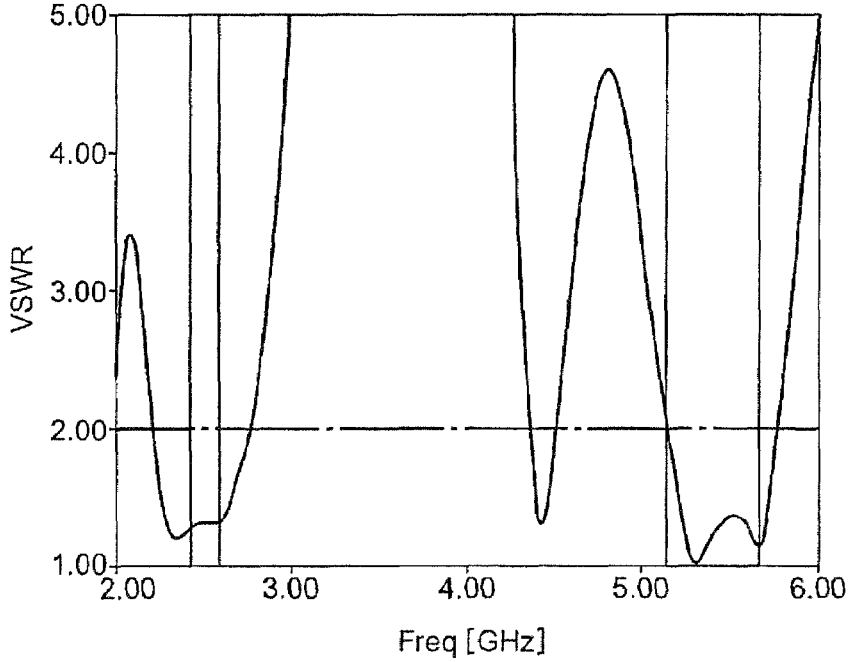
FIG. 5 is view showing a frequency characteristic of a VSWR of the antenna unit illustrated in FIGS. 1A and 1B.

FIG. 4 shows a frequency characteristic of a VSWR of an antenna unit where the second antenna pattern 30 is deleted from the antenna unit 10 illustrated in FIGS. 1A and 1B. FIG. 5 shows a frequency characteristic of a VSWR of the antenna unit 10 (namely, the second antenna pattern 30 exists). In FIGS. 4 and 5, the abscissa represents a frequency [GHz] and the ordinate represents the VSWR. In FIGS. 4 and 5, a frequency range between 2,413 MHz and 2,474 MHz enclosed with a rectangle at a lower frequency side represents the first frequency band of 2.4 GHz used in the IEEE 802.11b/g while a frequency range between 5,150 MHz to 5,725 MHz enclosed with a rectangle at a higher frequency side represents the second frequency band of 5 GHz used in the IEEE 802.11a.

As apparent from FIG. 4, it is seen that the antenna unit where the second antenna pattern 30 is deleted has the VSWR of two or less at the first frequency range band of 2.4 GHz and has the VSWR of two or more in the second frequency band of 5 GHz.

On the other hand, as apparent from FIG. 5 it is seen that the antenna unit 10 according to the first exemplary embodiment of this invention has the VSWR of two or less at both of the first frequency band of 2.4 GHz and the second frequency band of 5 GHz.

That is, it is possible for the antenna unit (the board antenna) 10 according to the first exemplary embodiment of this invention to obtain a matching characteristic not only at the 2.4 GHz band but also at the 5 GHz band. In other words, the antenna unit (the board antenna) 10 according to the first exemplary embodiment of this invention serves as a wireless LAN multi-band board antenna which is possible to transmit and receive the first radio wave having the first frequency band of 2.4 GHz for the IEEE 802.11b/g and the second radio wave having the second frequency band of 5 GHz for the IEEE 802.11a.

Herein, in the pair of conductive patterns 31 and 32 of the second antenna pattern 30, the first and the second widened portions 311 and 321 are for covering (securing) a band width of the second frequency band of 5 GHz and a combination of the first and the second main wiring patterns 312 and 322 and the first and the second sub wiring patterns 313 and 323 is for bring the VSWR near to one.

In addition, the second antenna pattern 30 formed on the second surface (the lower surface, the rear side) 12*d* of the board 12 is not restricted to that illustrated in FIG. 2 and a variety of modifications may be made.

Figure 6:
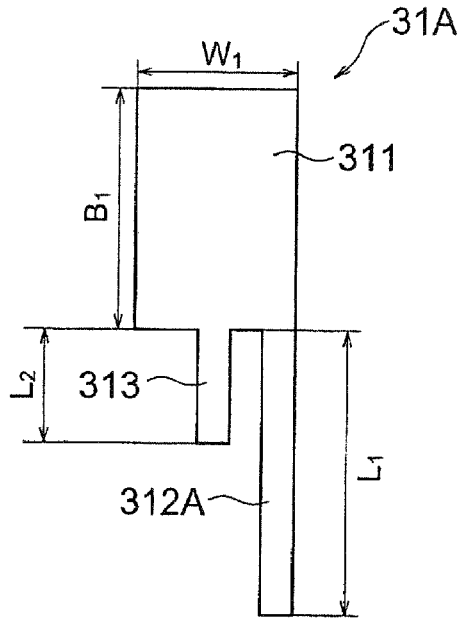
FIG. 6 is a plan view showing a first modified example of a first conductive pattern of the second antenna pattern for use in the antenna unit illustrated in FIGS. 1A and 1B.

FIG. 6 is a plan view showing a first modified example of a first conductive pattern 31A of the second antenna pattern. Although illustration is omitted, as a matter of course, a second conductive pattern of the second antenna pattern has a symmetrical shape to the first conductive pattern 31A with respect to the center line X of the board 12. The illustrated first conductive pattern 31A is similar in structure to the first conductive pattern 31 illustrated in FIG. 2 except that the first main wiring pattern is different in structure from that illustrated in FIG. 2. The first main wiring pattern is therefore depicted at 312A.

The first main wiring pattern 312A has a tip portion which is not bended. The first main wiring pattern 312A extends in parallel with the center line X of the board 12 along the right-side surface 13*rs* of the board 12 from the first widened portion 311 so as to be opposed to the first parallel wiring portion 212. The first main wiring pattern 312A had the wiring length L1 of 9 mm.

Figure 7:
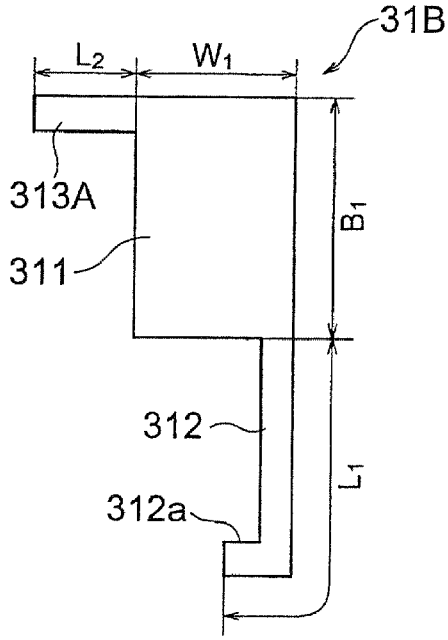
FIG. 7 is a plan view showing a second modified example of a first conductive pattern of the second antenna pattern for use in the antenna unit illustrated in FIGS. 1A and 1B.

FIG. 7 is a plan view showing a second modified example of a first conductive pattern 31B of the second antenna pattern. Although illustration is omitted, as a matter of course, a second conductive pattern of the second antenna pattern has a symmetrical shape to the first conductive pattern 31B with respect to the center line X of the board 12. The illustrated first conductive pattern 31B is similar in structure to the first conductive pattern 31 illustrated in FIG. 2 except that the first sub wiring pattern is different in a disposed position from that illustrated in FIG. 2. The first sub wiring pattern is therefore depicted at 313A.

The first sub wiring pattern 313A is disposed opposite to the first orthogonal wiring portion 211 (FIG. 1A) along the front surface 12*f* of the board 12 so as to get near the center line X from the first widened portion 311. The first sub wiring pattern 313A has the wiring length $L_2$ of 3.2 mm. Although illustration is omitted, a second sub wiring pattern of the second conductive pattern is disposed opposite to the second orthogonal wiring portion 221 (FIG. 1A) along the front surface 12*f* of the board 12 so as to get near the center line X from the second widened portion 321.

Figure 8:
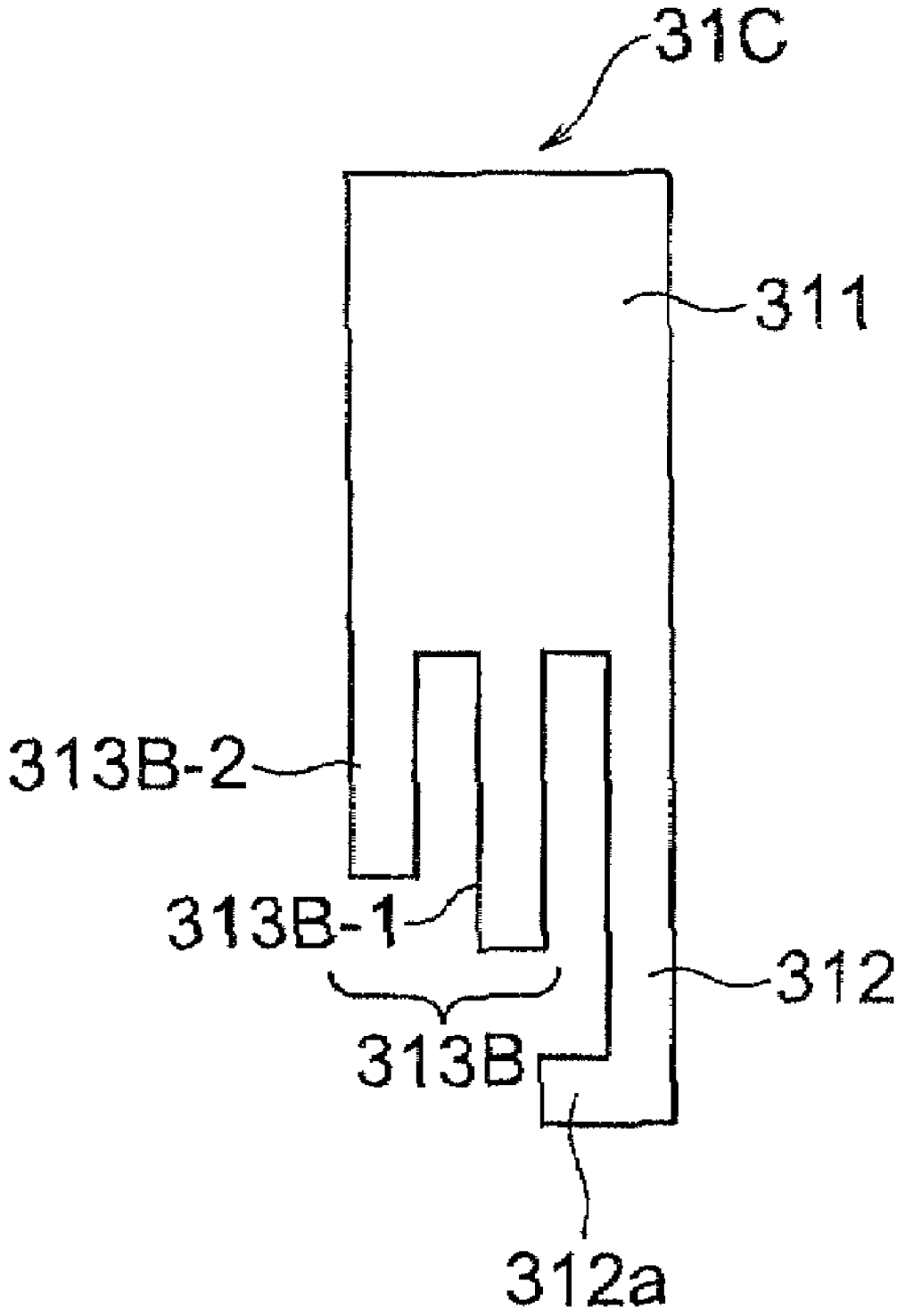
FIG. 8 is a plan view showing a second modified example of a first conductive pattern of the second antenna pattern for use in the antenna unit illustrated in FIGS. 1A and 1B.

FIG. 8 is a plan view showing a third modified example of a first conductive pattern 31C of the second antenna pattern. Although illustration is omitted, as a matter of course, a second conductive pattern of the second antenna pattern has a symmetrical shape to the first conductive pattern 31C with respect to the center line X of the board 12. The illustrated first conductive pattern 31C is similar in structure to the first conductive pattern 31 illustrated in FIG. 2 except that the first sub wiring pattern is different in structure from that illustrated in FIG. 2. The first sub wiring pattern is therefore depicted at 313B.

The first sub wiring pattern 313B comprises a first sub wiring portion 313B-1 and a second sub wiring portion 313B-2. The first sub wiring portion 313B-1 is apart from the first main wiring pattern 312 by the predetermined distance $D_1$ and extends in parallel with the first main wiring pattern 312. The second sub wiring portion 313B-2 is apart from the first sub wiring portion 313B-1 by the predetermined distance $D_1$ and extends in parallel with the first main wiring pattern 312.

In the above-mentioned exemplary aspect of this invention, the first frequency band may, for example, be a frequency band of 2.4 GHz and the second frequency band may, for example, be a frequency band of 5 GHz. The board may have a center line. In this event, the first antenna pattern may extend in an L-shaped fashion at both sides with respect to the central line of the board and the first antenna pattern may have a substantially U-shape as a whole. The second antenna pattern may include a pair of conductive patterns which are symmetrically formed at the both sides with respect to the center line of the board.

The first antenna pattern preferably may include first and second L-shaped wiring pattern formed at first and second sides opposite to each other with respect to the center line of the board, an L-shaped ground pattern, and an L-shaped signal pattern. The first and the second L-shaped wiring patterns may have first and second tips, respectively, which are opposed to each other with a space through the center line of the board. The first and the second L-shaped wiring patterns may be substantially symmetric with respect to the center line of the board. The L-shaped ground pattern may have a first end which is electrically connected to the second tip of the second L-shaped wiring pattern. The L-shaped ground pattern may be formed on the first surface of the board such that the L-shaped ground pattern lies inside the second L-shaped wiring pattern with a space and along the second L-shaped wiring pattern. The L-shaped signal pattern may have a first end which is electrically connected to the first tip of the first L-shaped wiring pattern. The L-shaped signal pattern may be formed on the first surface of the board such that the L-shaped signal pattern lies inside the L-shaped ground pattern with a space and along the L-shaped ground pattern. The antenna unit may further include a coaxial cable having a tip portion which is connected to the first antenna pattern. In this event, the coaxial cable includes a central conductor and an outer conductor. The central conductor is connected to a second end of the L-shaped signal pattern at the tip portion of the coaxial cable. The outer conductor is connected to a second end of the L-shaped ground pattern at the tip portion of the coaxial cable.

On the other hand, the pair of conductive patterns preferably may include a first conductive pattern disposed on the second surface of the board so as to be opposed to the first L-shaped wiring pattern through the board, and a second conductive pattern disposed on the second surface of the board so as to be opposed to the second L-shaped wiring pattern through the board.

The first L-shaped wiring pattern may include a first orthogonal wiring portion extending in a direction orthogonal to the center line of the board so as to leave the center line of the board, and a first parallel wiring portion extending in parallel with the center line of the board from a tip of the first orthogonal wiring portion. The said second L-shaped wiring pattern may include a second orthogonal wiring portion extending in a direction orthogonal to the center line of the board so as to leave the center line of the board, and a second parallel wiring portion extending in parallel with the center line of the board from a tip of the second orthogonal wiring portion. In this event, the first conductive pattern preferably may include, at least, a first widened portion and a first main wiring pattern. The first widened portion is disposed at a position corresponding to a curved portion of the first L-shaped wiring pattern. The first widened portion has a rectangular shape of a width which is wider than a line width of the first L-shaped wiring pattern. The first main wiring pattern extends in parallel with the center line of the board from the first widened portion so as to be opposed to the first parallel wiring portion. The second conductive pattern preferably may include, at least, a second widened portion and a second main wiring pattern. The second widened portion is disposed at a position corresponding to a curved portion of the second L-shaped wiring pattern. The second widened portion has a rectangular shape of a width which is wider than a line width of the second L-shaped wiring pattern. The second main wiring pattern extends in parallel with the center line of the board from the second widened portion so as to be opposed to the second parallel wiring portion. The first main wiring pattern may have a tip portion which is bended at the right angle in a direction to get near the center line of the board. The second main wiring portion may have a tip portion which is bended at the right angle in a direction to get near the center line of the board.

Furthermore, the first conductive pattern preferably may further include a first sub wiring pattern which extends from the first widened portion. The first sub wiring pattern has a length which is shorter than a wiring length of the first main wiring pattern. The second conductive pattern preferably may further include a second sub wiring pattern which extends from the second widened portion. The second sub wiring pattern has a length which is shorter than a wiring length of the second main wiring pattern. The first sub wiring pattern may be apart from the first main wiring pattern by a predetermined distance and may extend in parallel with the first main wiring pattern. The second sub wiring pattern may be apart from the second main wiring pattern by the predetermined distance and may extend in parallel with the second main wiring pattern. Alternatively, the first sub wiring pattern may be disposed to be opposed to the first orthogonal wiring portion so as to get near the center line of the board from the first widened portion. The second sub wiring pattern may be disposed to be opposed to the second orthogonal wiring portion so as to get near the center line of the board from the second widened portion.

An exemplary advantage according to the invention is that the antenna unit can transmit and receive radio signals (radio waves) having different two kinds of frequency bands. This is because the first antenna pattern for transmitting and receiving the first radio wave having the first frequency band is formed on the first surface of the board, the second antenna pattern for transmitting and receiving the second radio wave having the second frequency band is formed on the second surface of the board, and the first antenna pattern and the second antenna pattern are disposed so as to be opposed to each other through said board with they electrically disconnected.

While the invention has been particularly shown and described with reference to exemplary embodiments thereof, the invention is not limited to these embodiments. it will be understood by those of ordinary skill in the art that various changes in form and details may be made therein without departing from the sprit and scope of the present invention as defined by the claims. For example, the first and the second antenna patterns are restricted to those in the above-mentioned exemplary embodiments, any pattern having various shapes may be adopted. At any rate, the first antenna pattern may transmit and receive the first radio wave having the first frequency band while the second antenna pattern may transmit and receive the second radio wave having the second frequency band. In addition, although each of the pair of conductive patterns composing the second pattern comprises the widened portion, the main wiring pattern, and the sub wiring pattern in the above-mentioned exemplary embodiments, the sub wiring pattern may be deleted from the conductive pattern.

What is claimed is:

1. An antenna unit comprising:

a board having first and second surfaces opposite to each other;

a first antenna pattern, formed on the first surface of said board, for transmitting and receiving a first radio wave having a first frequency band; and a second antenna pattern, formed on the second surface of said board, for transmitting and receiving a second radio wave having a second frequency band different from the first frequency band, wherein said first antenna pattern and said second antenna pattern are electrically disconnected from each other and are disposed so as to be opposed to each other through said board;

wherein said board has a center line;

wherein said first antenna pattern extends in an L-shaped fashion at both sides with respect to the central line of said board, said first antenna pattern having a substantially U-shape as a whole;

wherein said second antenna pattern comprises a pair of conductive patterns which are symmetrically formed at said both sides with respect to the center line of said board;

wherein said first antenna pattern comprises:

first and second L-shaped wiring patterns formed at first and second sides that are opposite to each other with respect to the center line of said board, said first and second L-shaped wiring patterns having first and second tips, respectively, which are opposed to each other with a space through the center line of said board, and said first and second L-shaped wiring patterns being substantially symmetric with respect to the center line of said board;

an L-shaped ground pattern having a first end which is electrically connected to the second tip of said second L-shaped wiring pattern, said L-shaped ground pattern being formed on the first surface of said board such that said L-shaped ground pattern lies inside said second L-shaped wiring pattern with a space and along said second L-shaped wiring pattern; and an L-shaped signal pattern having a first end which is electrically connected to the first tip of said first L-shaped wiring pattern, said L-shaped signal pattern being formed on the first surface of said board such that said L-shaped signal pattern lies inside said L-shaped ground pattern with a space and along said L-shaped ground pattern;

wherein said pair of conductive patterns comprises:

a first conductive pattern disposed on the second surface of said board so as to be opposed to said first L-shaped wiring pattern through said board; and a second conductive pattern disposed on the second surface of said board so as to be opposed to said second L-shaped wiring pattern through said board;

wherein said first L-shaped wiring pattern comprises:

a first orthogonal wiring portion extending in a direction orthogonal to the center line of said board so as to extend away from the center line of said board; and a first parallel wiring portion extending in parallel with the center line of said board from a tip of said first orthogonal wiring portion;

wherein said second L-shaped wiring pattern comprises:

a second orthogonal wiring portion extending in a direction orthogonal to the center line of said board so as to extend away from the center line of said board; and a second parallel wiring portion extending in parallel with the center line of said board from a tip of said second orthogonal wiring portion;

wherein said first conductive pattern comprises:

a first widened portion disposed at a position corresponding to a curved portion of said first L-shaped wiring pattern, said first widened portion having a rectangular shape with a width that is wider than a line width of said first L-shaped wiring pattern; and a first main wiring pattern extending in parallel with the center line of said board from said first widened portion so as to be opposed to said first parallel wiring portion; and wherein said second conductive pattern comprises:

a second widened portion disposed at a position corresponding to a curved portion of said second L-shaped wiring pattern, said second widened portion having a rectangular shape with a width that is wider than a line width of said second L-shaped wiring pattern; and a second main wiring pattern extending in parallel with the center line of said board from said second widened portion so as to be opposed to said second parallel wiring portion.

2. The antenna unit as claimed in claim 1, wherein said first frequency band is a frequency band of 2.4 GHz, and said second frequency band is a frequency band of 5 GHz.

3. The antenna unit as claimed in claim 1, further comprising a coaxial cable having a tip portion which is connected to said first antenna pattern.

4. The antenna unit as claimed in claim 3, wherein said coaxial cable includes a central conductor and an outer conductor, wherein the central conductor is connected to a second end of said L-shaped signal pattern at the tip portion of said coaxial cable, and wherein the outer conductor is connected to a second end of said L-shaped ground pattern at the tip portion of said coaxial cable.

5. The antenna unit as claimed in claim 1, wherein said first main wiring pattern has a tip portion which is bended at a right angle in a direction to extend toward the center line of said board, and wherein said second main wiring portion has a tip portion which is bended at the right angle in a direction to extend toward the center line of said board.

6. The antenna unit as claimed in claim 1, wherein said first conductive pattern further comprises a first sub wiring pattern which extends from said first widened portion, said first sub wiring pattern having a length which is shorter than a wiring length of said first main wiring pattern, and wherein said second conductive pattern further comprises a second sub wiring pattern which extends from said second widened portion, said second sub wiring pattern having a length which is shorter than a wiring length of said second main wiring pattern.

7. The antenna unit as claimed in claim 6, wherein said first sub wiring pattern is apart from said first main wiring pattern by a predetermined distance and extends in parallel with said first main wiring pattern, and wherein said second sub wiring pattern is apart from said second main wiring pattern by the predetermined distance and extends in parallel with said second main wiring pattern.

8. The antenna unit as claimed in claim 6, wherein said first sub wiring pattern is disposed to be opposed to said first orthogonal wiring portion so as to extend toward the center line of said board from said first widened portion, and wherein said second sub wiring pattern is disposed to be opposed to said second orthogonal wiring portion so as to extend toward the center line of said board from said second widened portion.

* * * * *